US007273301B2

(12) United States Patent
Mier-Langner et al.

(10) Patent No.: US 7,273,301 B2
(45) Date of Patent: Sep. 25, 2007

(54) LUMINAIRE CONSTRUCTION

(75) Inventors: Alejandro Mier-Langner, Providence, RI (US); James E. Kuchar, Fall River, MA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 118 days.

(21) Appl. No.: 11/122,586

(22) Filed: May 5, 2005

(65) Prior Publication Data

US 2005/0248941 A1 Nov. 10, 2005

Related U.S. Application Data

(60) Provisional application No. 60/568,836, filed on May 6, 2004.

(51) Int. Cl.
*F21S 8/02* (2006.01)

(52) U.S. Cl. ..... 362/364; 362/440; 362/147

(58) Field of Classification Search ..... 362/362, 362/364, 368, 370, 440, 147, 148, 232
See application file for complete search history.

(56) References Cited

U.S. PATENT DOCUMENTS 3,302,019 A * 1/1967 Menzin ..... 362/296

* cited by examiner

*Primary Examiner*—Sharon Payne
(74) *Attorney, Agent, or Firm*—John F. Salazar; Middleton Reutlinger

(57) ABSTRACT

A downwardly directed fixture is provided which has a fixture face, said face having a first and second annular recess, the first annular recess receiving a reflector flange and the second recess receiving a lens. The reflector flange is then held in position by a removable arc-shaped retention spring.

16 Claims, 5 Drawing Sheets

LUMINAIRE CONSTRUCTION

CROSS-REFERENCE TO RELATED APPLICATION

This application claims benefit under 35 USC 119(e) of Provisional Application No. 60/568,836, filed May 6, 2004, the entire disclosure of which is incorporated herein by reference.

TECHNICAL FIELD

The present invention is related to luminaire construction and more specifically to a downwardly directed luminaire with a removable reflector, the reflector being held within the luminaire housing after the removal of the lens by a retention clip.

BACKGROUND OF THE INVENTION

Various luminaire pictures are provided or have been provided for downward directed light. These fixtures when placed in a downward position may provide indirect wall wash or various track lighting capabilities. A problem arises however when these downwardly directed lights must be disassembled for replacement of the bulbs or the reflector or for access into the interior of the fixture. Commonly, various portions of the fixture are held together by a single retention mechanism. It is frequently the case that the lens assembly retains both the lens and reflector structure in place through the use of retention clips or other compressive mechanisms. However, upon removal of the retention clips directed to the lens, the lens will tend to fall away from the fixture while also allowing the reflector to fall away from the interior of the fixture. These two elements, the lens and the reflector are jointly held in place in many fixture by a single retention apparatus, the single retention apparatus typically directed towards the lens and providing compressive force against the lens.

It is thereby desirable to provide a downwardly directed fixture with a mechanism by which the lens may be removed without necessarily holding the lens in place so that the reflector does not fall away from the fixture upon removal of the lens.

SUMMARY OF THE INVENTION

It is therefore an object of the present invention to resolve the difficulties in accessing a downwardly directed fixture when disassembling the lens.

One object of the present invention is to therefore provide a downwardly directed light fixture, and a downwardly directed track light fixture, with both incandescent and HID capabilities and wherein the light source is surrounded by a reflector, the reflector being held in place regardless of the position of the lens.

A further object of the present invention is to provide a retention which lies against the outwardly directed flange of the reflector to hold the reflector in place.

A further object of the present invention is to provide an arc-shaped retention spring wherein the retention spring is deformable such that the diameter of the retention spring may be reduced to remove it from the fixture.

A further object of the present invention is to provide an arc-shaped retention spring wherein the retention spring lies within an annulus which is utilized to receive and secure the outwardly directed flange of the reflector such that the reflector is maintained in proper position after removal of the lens from the fixture.

It is a further object of the present invention to provide a downwardly directed light fixture wherein a first retaining mechanism is provided against the lens to secure the lens against the face of the light fixture while a second retaining mechanism is provided to secure the reflector against the light fixture face.

It is an additional object of the present invention to provide a light fixture face which has adjacent recessed annuluses formed on the face, each of the annuluses receiving separate structure, one structure being the lens and the other structure being the outwardly directed flange of the reflector, the reflector held at a different elevation than the lens.

A further object of the present invention is to provide both the reflector and lens in position against the face of the fixture while also providing a smooth appearance without significant disability of the various retention structure required.

These and further objects of the present invention are met utilizing the light fixture construction of the present invention.

DETAILED DESCRIPTION OF THE PREFERRED EMBODIMENTS

Figure 1:
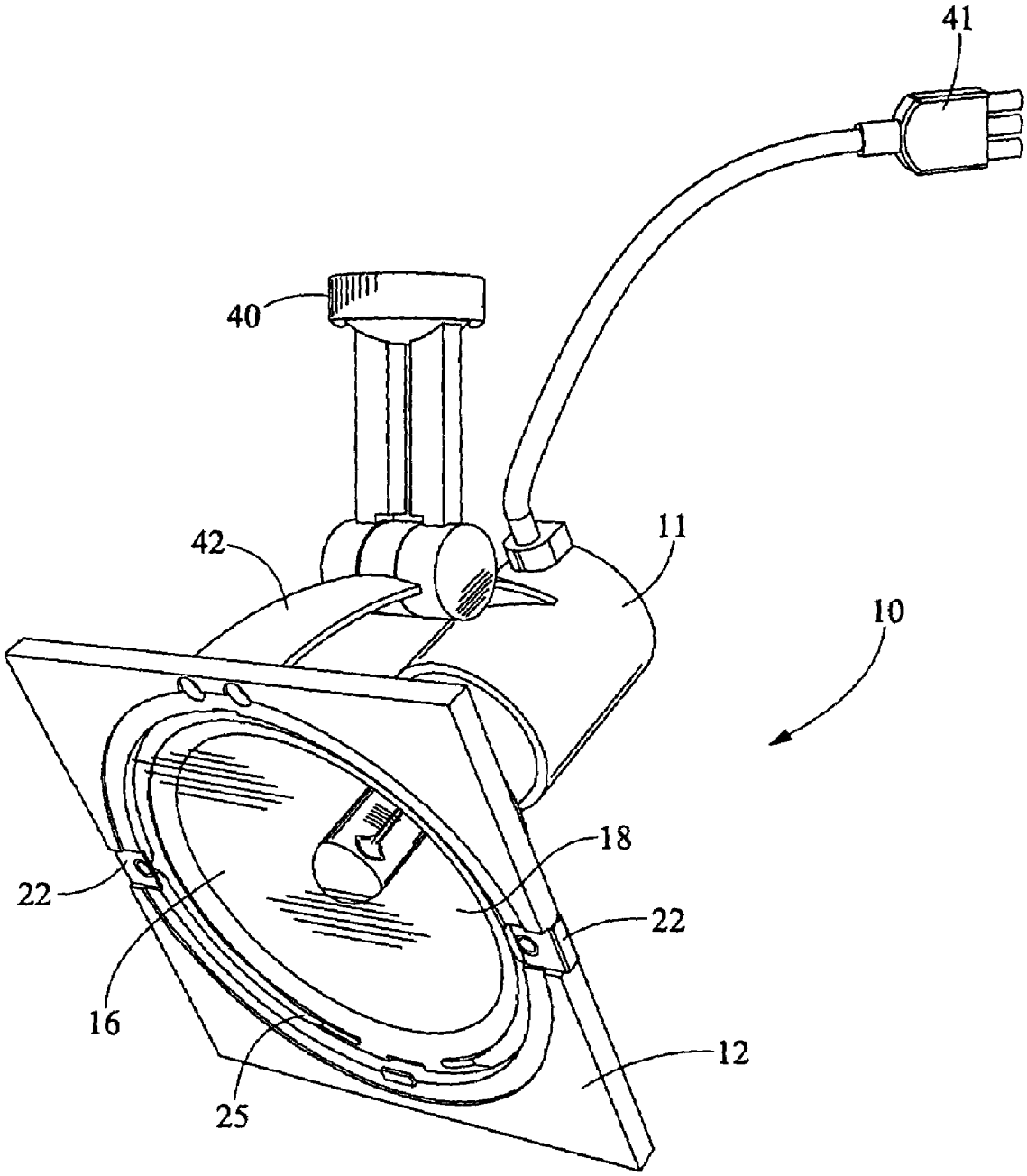
FIG. 1 is a perspective view of the luminaire construction of the present invention.

Referring to FIG. 1, the luminaire construction 10 of the present invention is depicted. One of the embodiments utilized in the concept of the construction for the luminaire construction is depicted in FIG. 1 and is shown as a track light fixture. As can be seen in the drawing, the fixture 10 is a track fixture which is suspended on a track by track connector 40. The track connector 40 is affixed by arm 42 to the socket cup 11 and the luminaire or fixture face 12. Interposed between the luminaire or fixture face and the socket cup 11 is the fixture shade 24, shown in FIG. 2, which is commonly bowl or parabolic-shaped and which opens outwardly from the socket cup to the luminaire face in defining an opening which is the light emitting portion of the fixture 10.

As is apparent in the embodiment shown in FIG. 1 many different or varying constructions may be utilized in order to define the light emitting opening of the luminaire. However, as is depicted, the fixture or luminaire face 12 has an opening which receives the reflector 16 therein. The reflector 16 surrounds lamp 33 which is retained in the socket cup 11. The reflector 16, as is shown in FIG. 1 and in FIG. 2, may be removed from the fixture and replaced due to the requirements of various lighting capabilities or environments. The reflector 16 is bowl shaped and substantially surrounds the lamp 33. As is shown, the reflector 16 also has an outwardly extending reflector annulus 34 or flange which may define the outermost perimeter of the reflector.

In the fixture design of the present invention, the construction is such that the reflector 16 may be removed from the fixture or luminaire 10. In the construction shown, the bowl-shaped fixture shade 24 surrounds the reflector 16 and extends from the fixture face 12 to the socket cup 11. However, as is readily apparent from the drawings included herewith, due to the arm 42 extending between the fixture face 12 and the socket cup 11, the bowl-shaped shade 24 is not necessarily required if it is desired to have the outer surface of the reflector visible. Thus, in such an embodiment, a gap or spacing will exist between the socket cup 11 and luminaire face 12 to be filled by the retained reflector 16.

Figure 3:
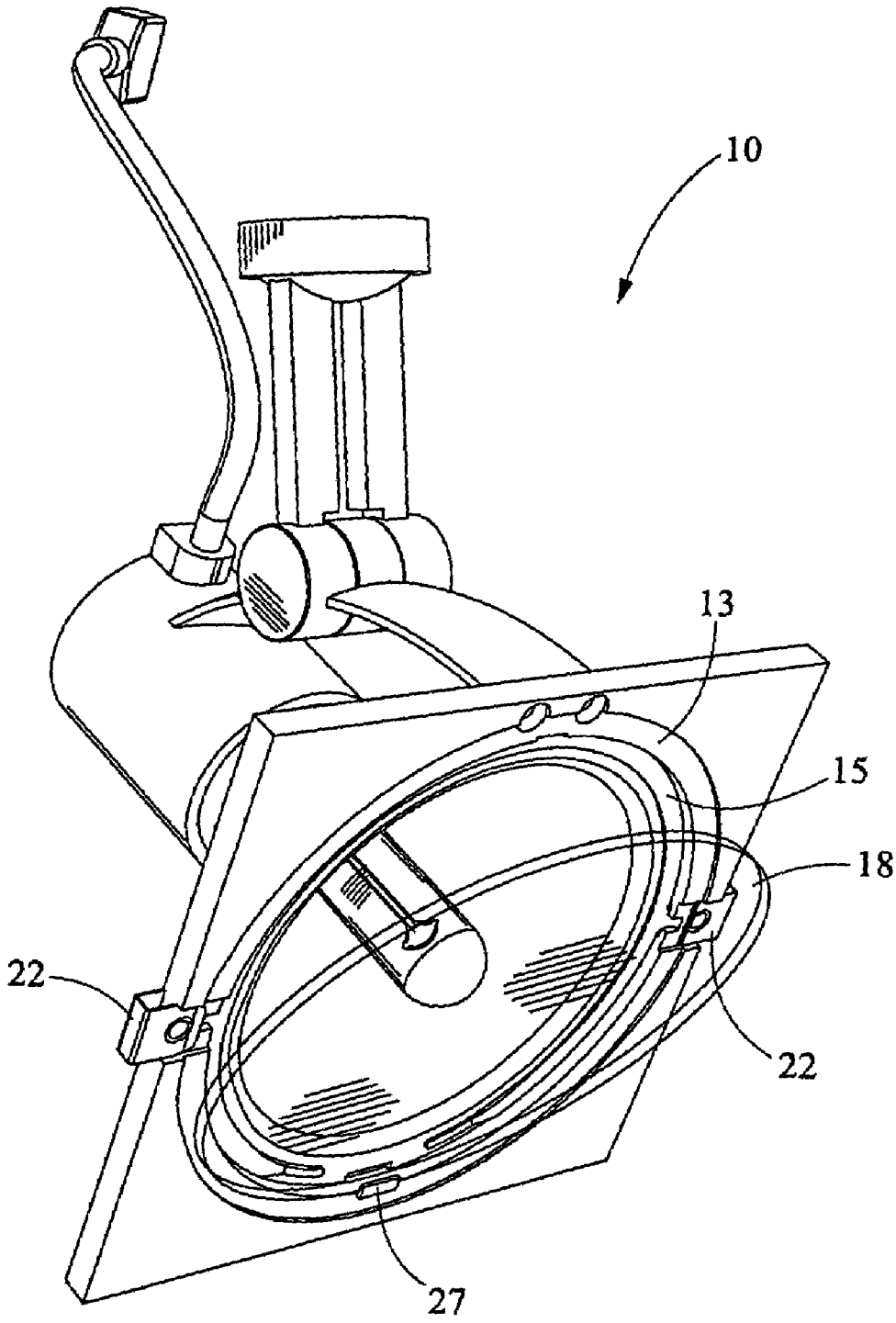
FIG. 3 is a partially disassembled view of the luminaire construction of the present invention.

In FIG. 1, as shown, the lens 18 extends over the opening formed in the luminaire or fixture face 12. The lens may be of any lighting characteristic and is shown in the drawings as being circular. The lens 18 fits over the opening formed in the luminaire face 12 and is held in place by lens springs 22 which slide outward away from the lens such that the lens may be removed. The lens springs 22, as shown in FIG. 3, are pulled away from the lens so the lens may be removed and also provide compressive force against the lens such that the lens is held securely in place against a surface of the luminaire or fixture face 12.

Aesthetically, it is desirable to reduce the amount of retaining mechanisms visible on the exterior of the luminaire 10. Thus, the spring clips in the example shown are on the outer periphery of the lens so as to not cause any shadowing from lamp 33. The clips or springs, therefore press downward on the lens along an outer peripheral annulus 13 which does not form any part of the illumination pathway.

Figure 2:
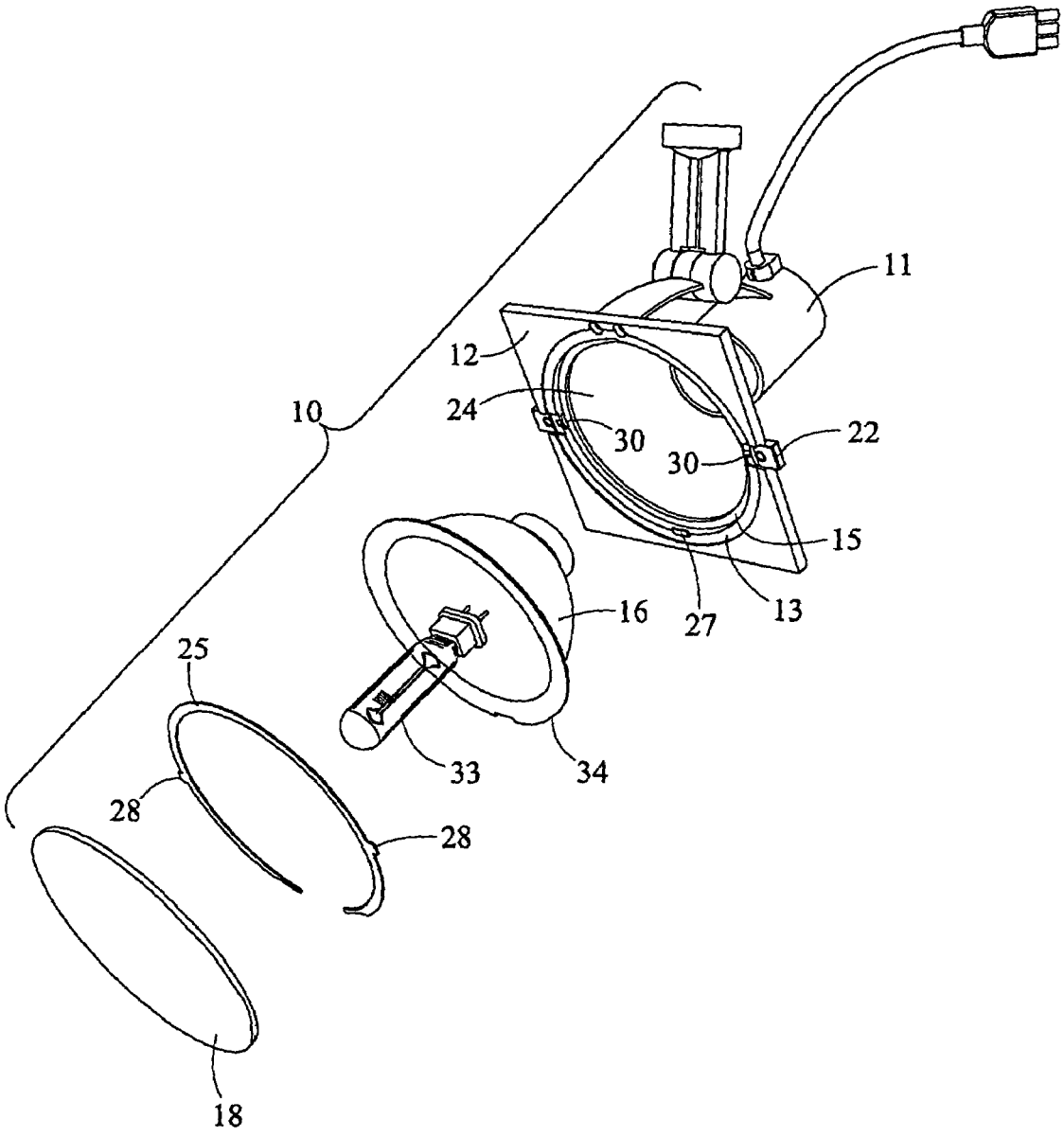
FIG. 2 is a exploded view of the construction of the luminaire of the present invention.

Formed in the fixture face 12 are first annulus 15 and second annulus 13. Both the first and the second annulus 15 and 13 are formed such that the reflector and lens are secured within the fixture face and the lens is flush with the front face thereof. The reflector annulus 34 formed on the reflector 16 rests securely within the first annulus 15 and may have a smaller diameter than the lens 18. The reflector, as shown in FIG. 2, substantially surrounds the lamp 33 and is interposed between the fixture face 12 and the socket cup 11. The reflector annulus 34 fits securely within the first annulus 15 and is easily removable therefrom due to the lack of frictional structure formed thereon. Consequently, a cleaner appearance is provided.

Figure 4:
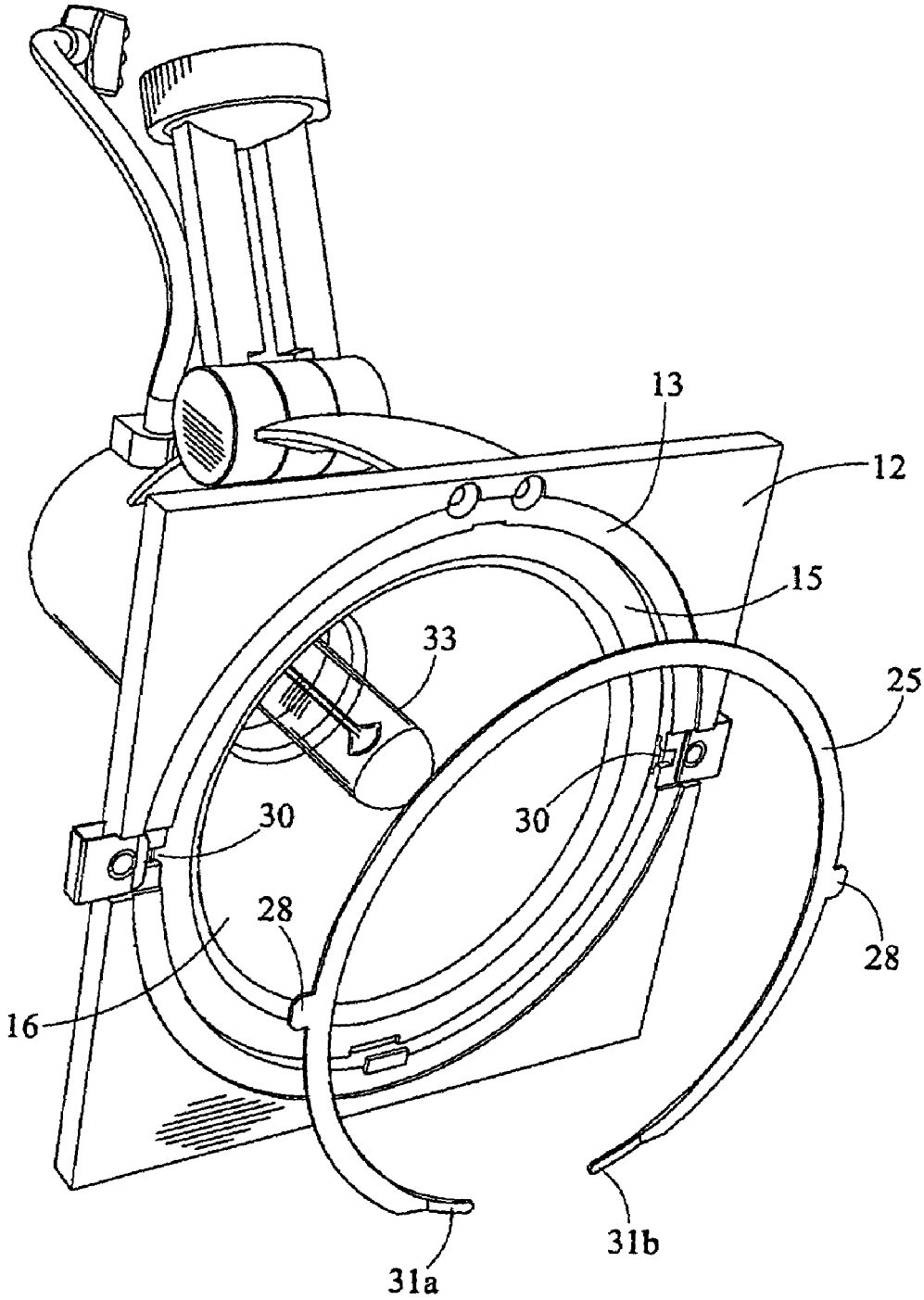
FIG. 4 is a partially dissembled view of the luminaire of the present invention; and, FIG. 5 is a perspective view of the retention mechanism for use with the present invention.
Figure 5:
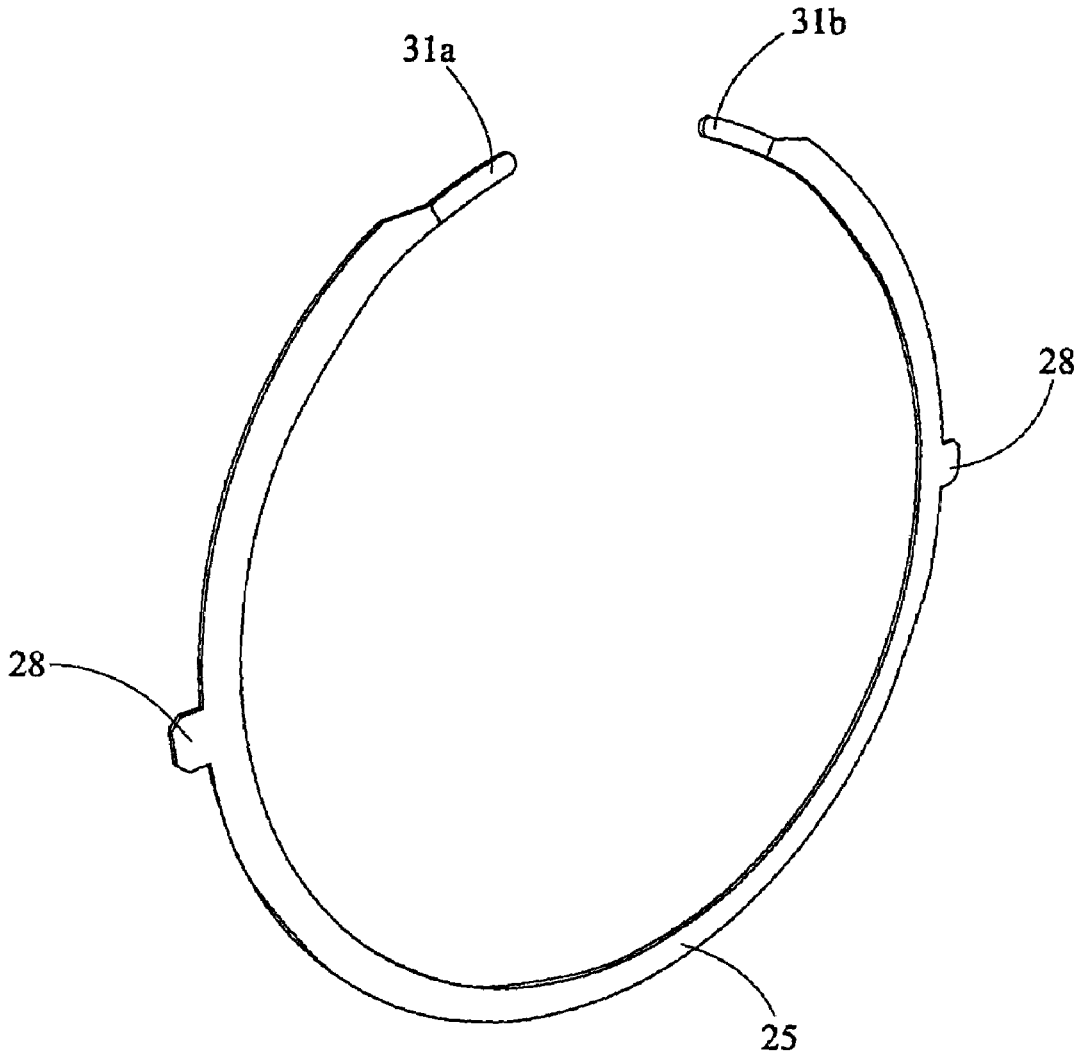

Second annulus 13 has a larger diameter than first annulus 15 and is not as deeply recessed into the fixture face 12 as first annulus 15. Second annulus 13 extends around first annulus 15 and allows the lens 18 to be secured against the fixture face 12 by virtue of the lens springs 22 discussed. As can be seen from FIG. 2, in construction of the fixture 10 of the present invention, the reflector 16 has reflector annulus 34 which rests within the first annulus 15 and is readily removed from the fixture 10. In order to retain the reflector in position, a retention spring 25 is provided. The retention spring 25 also rests within the first annulus 15 and is positioned directly against the top surface of the reflector annulus 34. If the retention spring 25 were not provided to have an interference fit against the top surface of the fixture face 12, as soon as the lens 18 is removed from the fixture, the reflector 16 would drop out as it is not retained or secured within socket cup 11 and due to the downwardly directed nature of the luminaire. Thus, retention spring 25 is provided in order to securely retain the reflector in position. Particularly, the retention spring 25 is removably retained in position in the first annulus 15 by virtue of tabs 28. Tabs 28 are removably received in notches 30 or other tab receiving gap or other area formed in the luminaire face 12 adjacent to the first annulus 15. The retention spring 25 is an arc-shaped metallic retention spring which is readily deformable and which has first and second ends 31*a* and 31*b*, shown in FIG. 4 and FIG. 5. The retention spring is a flat retention mechanism which is designed to fit or lay directly against the top surface of reflector annulus 34 and is designed to be as minimally visible as possible. Thus, it may be desirable to make the retention spring 25 as similar to the color of the top surface of reflector annulus 34. By making the retention mechanism or retention spring 25 of a flat, light weight and deformable material, the retention mechanism may be readily deformed so that the tabs 28 come out of notches 30 by providing a force against either first or second end 31*a* or 31*b* of the retention spring 25. Thus, by providing an inward force on either end of the retention spring 25, the diameter of the arc-shaped retention spring mechanism is reduced thereby causing the tab on the side to which pressure or force is applied, to come out of the notch 30 in the fixture face 12.

Returning to FIG. 2 and the overall construction of luminaire 10 of the present invention, the retention mechanism or spring 25 rests against the top surface of reflector annulus 34 and retains the reflector annulus flush against first annulus 15 of the fixture face 12. Surrounding the first annulus 15 of the fixture face 12 is the second annulus 13 which may be similarly recessed in the fixture face 12 and which is designed to receive the lens 18. Thus, the diameter of lens 18 will be substantially similar to the diameter of the second annulus 13. Further, the depth of the second annulus 13 may be such that the lens is flush against the luminaire fixture face 12 when put in place within the second annulus 13. As is further shown in the Figures, the lens 18 may be retained in the second annulus by lens springs 22 which slide over the lens and compressively apply force to retain the lens in position. Further, a holding tab 27 may be provided on the lower edge of the second annulus 13 in order to retain the lens 18 within the second annulus 13. As is apparent and as is shown in FIG. 3, once the lens springs 22 are pulled away from the lens 18, the lens will tend to want to fall directly out of the second annulus 13. By providing the holding tab 27, after removal of the lens springs 22 from compressive relationship against the lens 18, the lens will tilt forward allowing the installer to readily grasp the lens and remove it from the face 12.

After removal of the lens, the reflector 16 is held and maintained in proper position even though the compressive springs 22 are removed from the lens. Commonly, prior designs required that the reflector either be secured in position within the socket cup 11 or the reflector 16 maintain its position within the fixture 10 as a result of the lens springs 22 forming pressure on the lens and, coincidentally, on the outward flange or reflector annulus 34. Thus, when the lens springs 22 were removed from the lens 18, the entire assembly would tend to drop out and particularly the lens would tend to fall away.

While the description herein has been provided with respect to the light fixture depicted in the drawings, it is apparent that the embodiments shown in the drawings are used in relationship with a track lighting system since track lighting often allows for downwardly directed light. As is seen in the drawings, the embodiment utilizing the retention mechanism of the present invention incorporate a track connector 40 attached to an overhead track while also having electrical cord 41 for electrical connection to a power supply. In the configuration shown, the fixture is maintained in a downward direction and the lens and reflector unit are securely maintained in position against the light fixture or track light face. It is also apparent that the retention mechanism for retaining the reflector in position underneath the lens may be utilized for incandescent or HID lighting systems and on track light fixture or other type of luminaire. Therefore, the particular aspects of the exemplinary fixture shown in the drawings should not be considered limiting as these variations are well within the skill in the art and are not deemed to significantly limit the teachings and disclosures contained herein.

The invention claimed is:

1. A downwardly directed luminaire, comprising:

a luminaire face having a first annulus and a second annulus;

a reflector having a reflector annulus resting in said first annulus of said luminaire face substantially surrounding a lamp;

a lens resting in the second annulus of said luminaire face;

a removable retention spring interposed between said lens and said reflector and having at least one locking mechanism and wherein said spring rests within said second annulus; and wherein said locking mechanism is an at least one outwardly extending tab removably received within a notch adjacent said first annulus.

2. The downwardly directed luminaire of claim 1 wherein said spring is an arc-shaped spring having first and second ends.

3. The downwardly directed luminaire of claim 2 wherein the diameter of said spring is alterable.

4. The downwardly directed luminaire of claim 1 wherein said lens is secured by at least one lens spring as a side of said luminaire face.

5. The downwardly directed luminaire of claim 4 wherein said at least one lens spring is positioned above said notch.

6. The downwardly directed luminaire of claim 2 further comprising a second outwardly extending tab removably received within a second notch formed adjacent said first annulus.

7. The downwardly directed luminaire of claim 4 wherein said at least one lens spring compressively engages against said lens.

8. A downwardly facing fixture, comprising:

a socket cup retaining a lamp and an outwardly extending shade receiving a reflector;

a fixture face having a first and adjacent second recessed annulus, said reflector having an outwardly extending flange, said flange received against said first annulus;

an arc-shaped deformable retention spring resting on said reflector flange, said retention spring having opposed tabs received within a tab receiving area within said fixture face and retaining said reflector in said shade;

a lens resting on said second annulus and contacted by a lens retention spring, said arc-shaped retention spring interposed between said lens and said reflector flange.

9. A light fixture with a removable reflector and lens, comprising:

a fixture housing receiving a reflector, said reflector surrounding a lamp retained in said fixture housing and having an outwardly extending flange;

said fixture housing having an annular recess receiving said flange of said reflector;

an arc-shaped retention mechanism overlaying said flange of said reflector in said annular recess and removably locked into position into said annular recess;

a lens extending over an opening in said reflector and retained against said fixture housing by at least one lens spring.

10. The light fixture of claim 9 wherein said retention mechanism is a flat deformable arc-shaped spring having a first and a second end.

11. The light fixture of claim 9 wherein said retention mechanism has a first and second tab extending outward and received within a first and a second notch formed in said annular recess.

12. The light fixture of claim 9 wherein said fixture housing has a second annular recess which receives said lens.

13. An inverted light fixture comprising:

a fixture face having an opening and affixed to a socket cup, said fixture face having a first annulus surrounding said opening;

a lamp retained in said fixture by said socket cup and extending outward from said socket cup towards said opening of said fixture face;

a removable reflector substantially surrounding said lamp and having an outwardly extending flange received within said first annulus;

a flat retention member overlaying said flange of said reflector and in interference fit with said first annulus;

a lens removably retained and extending substantially over said opening in said fixture face.

14. The light fixture of claim 13 wherein said flat retention member is an arc-shaped deformable retention spring.

15. The fixture of claim 14 wherein said retention member farther has a first and second end and a first and second tab, said first annulus having a first and a second notch removably receiving said first and said second tab.

16. The fixture of claim 15 farther having a second annulus surrounding said first annulus such that said lens is flush with said fixture face.

* * * * *